US011850491B2

(12) United States Patent
Cohen

(10) Patent No.: US 11,850,491 B2
(45) Date of Patent: Dec. 26, 2023

(54) ATHLETIC GRASP TRAINING ARTICLES, KITS, AND METHODS

(71) Applicant: Christopher Cohen, Portland, ME (US)

(72) Inventor: Christopher Cohen, Portland, ME (US)

( * ) Notice: Subject to any disclaimer, the term of this patent is extended or adjusted under 35 U.S.C. 154(b) by 0 days.

(21) Appl. No.: 17/835,865

(22) Filed: Jun. 8, 2022

(65) Prior Publication Data

US 2022/0395738 A1 Dec. 15, 2022

Related U.S. Application Data

(60) Provisional application No. 63/208,819, filed on Jun. 9, 2021.

(51) Int. Cl.

| | |
|---|---|
| ***A63B 69/36*** | (2006.01) |
| ***A63B 23/16*** | (2006.01) |
| ***A63B 69/00*** | (2006.01) |
| *A63B 102/18* | (2015.01) |

(52) U.S. Cl.

CPC ..... *A63B 69/3608* (2013.01); *A63B 23/16* (2013.01); *A63B 69/0002* (2013.01); *A63B 69/0015* (2013.01); *A63B 2069/0008* (2013.01); *A63B 2102/182* (2015.10); *A63B 2214/00* (2020.08)

(58) Field of Classification Search

CPC . A63B 69/3608; A63B 23/16; A63B 69/0002; A63B 69/0015; A63B 2069/0008; A63B 2102/182; A63B 2214/00

USPC ..... 473/201, 205, 206, 523, 538, 549, 551, 473/568

See application file for complete search history.

(56) References Cited

U.S. PATENT DOCUMENTS

| | | | | |
|---|---|---|---|---|
| 2,962,288 | A * | 11/1960 | Lowden | A63B 53/007 473/206 |
| 4,461,043 | A * | 7/1984 | Lomedico | A63B 71/146 2/21 |
| 5,403,008 | A * | 4/1995 | Mainiero | A63B 69/36 473/201 |
| 7,125,353 | B2 | 10/2006 | Blount | |
| 7,128,656 | B1 * | 10/2006 | Orchel | A63B 60/10 473/205 |
| 7,351,167 | B1 | 4/2008 | Hathaway | |
| 7,572,198 | B2 | 8/2009 | Bleecker | |

(Continued)

FOREIGN PATENT DOCUMENTS

| | | | |
|---|---|---|---|
| EP | 3166700 | A | 7/2019 |

*Primary Examiner* — Nini F Legesse

(74) *Attorney, Agent, or Firm* — The Law Firm of Andrea Hence Evans, LLC

(57) ABSTRACT

Articles, kits, and methods for enabling an individual to improve their top-hand grasp of a handled object, such as a baseball bat. An article has an arcuate inner portion having a groove that extends along a length thereof, configured to reversibly engage the handled object. The article also has an irregular outer portion with a thumb support that arcuately extends from the irregular outer portion, configured to reversibly engage the individual's top-hand. During use of the article in a method of the invention, the article enables the individual to grasp the handled object with the fingers of their top-hand, rather than the palm and thumb of their top-hand, to improve acceleration, velocity, precision, accuracy, and form of the individual's swing when the article is not used, as well as improved safety and consistent grip technique when it is used.

18 Claims, 20 Drawing Sheets

(56) References Cited

U.S. PATENT DOCUMENTS

| | | | | |
|---|---|---|---|---|
| 8,602,925 | B1 * | 12/2013 | Rickon, Jr. | A63B 60/14 473/568 |
| 8,708,846 | B2 | 4/2014 | Hisle, Jr. et al. | |
| 10,046,215 | B2 | 8/2018 | Eastman | |
| 2005/0124428 | A1 * | 6/2005 | Kelly | A63B 69/3608 473/201 |
| 2020/0122008 | A1 | 4/2020 | Leinert | |
| 2020/0352261 | A1 * | 11/2020 | First | A41D 13/082 |

* cited by examiner

ATHLETIC GRASP TRAINING ARTICLES, KITS, AND METHODS

CROSS-REFERENCE TO RELATED APPLICATIONS

Under provisions of 35 U.S.C. § 119(e), the Applicant claims the benefit of U.S. provisional application No. 63/208,819, filed Jun. 9, 2021, which is incorporated herein by reference. It is intended that the referenced application may be applicable to the concepts and embodiments disclosed herein, even if such concepts and embodiments are disclosed in the referenced application with different limitations and configurations and described using different examples and terminology.

FIELD

The disclosure relates to articles, kits, and methods for improved training and development of an individual's grasp of a handled object, such as a baseball bat, that may be intended for a two-handed grasp (i.e., a top-hand and a bottom-hand). An article of the disclosure engages the handled object and at least the individual's top-hand for adjustment of the top-hand grasp during training to improve the individual's swing when the article is not used, as well as improved safety and consistent grip technique when the article is used.

BACKGROUND

Many athletes, such as players of baseball, tee-ball, softball, cricket, golf, and the like, use a handled object, such as a bat or a club, to strike a ball during play. There are many aspects that contribute to a player's swing mechanics, including hand placement and points of contact between the hands and the handled object. The two-handed grasp, which may typically be used in such sports, involves placement of a bottom-hand nearer to a bottom (i.e., handle end) of the handled object and placement of a top-hand nearer to a top (i.e., contact end) of the handled object. Specifically, for a right-handed swing (i.e., the handled object is swung from the individual's right side to the individual's left side), the right hand would generally be the top-hand while the left hand would generally be the bottom-hand. Similarly, for a left-handed swing (i.e., the handled object is swung from the individual's left side to the individual's right side), the left hand would generally be the top-hand while the right hand would generally be the bottom-hand.

An effective grasp of the handled object, which may help to maximize acceleration, velocity, precision, accuracy, and form of the individual's swing, typically requires that the top-hand grasps the handled object using the fingers rather than the thumb and palm. This technique may be a central part of proper swing mechanics. However, while the benefits of this technique may be known, many athletes may nevertheless tend to grasp the handled object with the thumb and palm of the top-hand, rather than the fingers. Efforts to train and correct the top-hand grasp during practice may not eliminate the issue because muscle memory for the incorrect technique may resurface during moments of stress or competition.

Accordingly, there is a need for articles, kits, and methods for effectively training the top-hand grasp such that the form and effect of the individual's swing is improved in all scenarios, including but not necessarily limited to training, practice, competition, demonstration, and coaching. The present invention addresses this unmet need.

SUMMARY

In one aspect, the invention relates to articles, kits, and methods for enabling an individual to improve their top-hand grasp of a handled object, such as a baseball bat, a tee-ball bat, a softball bat, a cricket bat, a golf club, and the like. The article may be comprised of an irregular and ergonomic shape and may be configured to engage both the handled object and the top-hand during use. The article may be flexible or inflexible, however, may be at least somewhat squeezable to enable the individual to settle into a top-hand grasp that suits their individual anatomy and grasp. The article may include an arcuate inner portion having a groove that extends along a length thereof, configured to reversibly engage the handled object, as well as an irregular outer portion with a thumb support that arcuately extends from the irregular outer portion, configured to reversibly engage the individual's top-hand. During use of the article in a method of the invention, the article enables the individual to grasp the handled object with the fingers of their top-hand, rather than the palm and thumb of their top-hand, to improve acceleration, velocity, precision, accuracy, and form of the individual's swing when the article is not used. The article also enables the individual to grasp the handled object with a greater contact area than when not using it, which increases handle control and reduces stress and tension on the hand and wrist.

The article may be chiral and may be configured for either a left hand or a right hand, but not both. The article may be continuous and unitary in structure (e.g., may not comprise multiple pieces). To improve ergonomic grasping by the top-hand, a width of the article may taper from a medial portion to a lower portion of the article.

The arcuate inner portion of the article may comprise a groove that extends along a longitudinal axis of the article that is configured to secure the article to the handled object during use. The groove may extend along a full length of the arcuate inner portion to maximize the engagement between the article and the handled object.

The thumb support may arcuately extend outward, from the irregular outer portion and away from the arcuate inner portion, to provide a contact surface for the thumb of the top-hand when the article is engaged thereto. The thumb support may form a semi-circular loop into which the thumb of the individual's top-hand may be inserted to enable the individual to grasp the article and any handled object with less risk of losing their grasp of either item.

Methods are provided for training or improving the top-hand grasp of the handled object, which comprise contacting an irregular outer portion of an article with the palm and thumb of the individual's top-hand, contacting the thumb of the individual's top-hand with a thumb support of the irregular outer portion, contacting an arcuate inner portion of the article with the handled object, grasping the handled object with the fingers of the individual's top-hand, and swinging the handled object according to a technique. The methods may be performed in any suitable order or number of steps; for example, the article may contact the handled object firstly and may contact the top-hand secondly. The methods may further comprise adjusting the technique, as may occur as a result of training or practice, as a result of advice received from a coach or instructor, as a result of watching a video or an image of the technique, or any combination thereof. The technique may be an athletic technique for use with a sport, such as swinging the handled object as part of practicing or playing baseball, tee-ball, softball, cricket, golf, or any combination thereof.

Kits are provided which comprise at least one article of the invention. The kits may further comprise additional items, such as the handled object, one or more instructional materials, and the like. The instructional materials may be provided for guiding an individual through proper use and maintenance of at least one article of the kit.

The invention generally relates to improved implementations for training or adjusting athletic techniques, and provides articles, devices, and the like which may be manufactured with appropriate materials and processes and which may be scaled as needed.

Other objects, features, and advantages of the invention will become apparent from the following detailed description taken in conjunction with the accompanying drawings.

BRIEF DESCRIPTION OF THE DRAWINGS

Although the characteristic features of the invention will be particularly pointed out in the claims, the invention itself and manners in which it may be made and used may be better understood after a review of the following description, taken in connection with the accompanying drawings, wherein like numeral annotations are provided throughout.

When describing the figures, the direction of the thumb support is always "forward" or "frontal", or "front", etc., for purposes of orienting the reader. In addition, while only the right-handed embodiment is explicitly shown in use by a user and attached to a handled object, the left-handed embodiment may be similarly used, with the use of the left-handed embodiment corresponding to a mirror of the use of the right-handed embodiment, as would be understood by the person having ordinary skill in the art.

DETAILED DESCRIPTION OF THE INVENTION

Figure 1A:
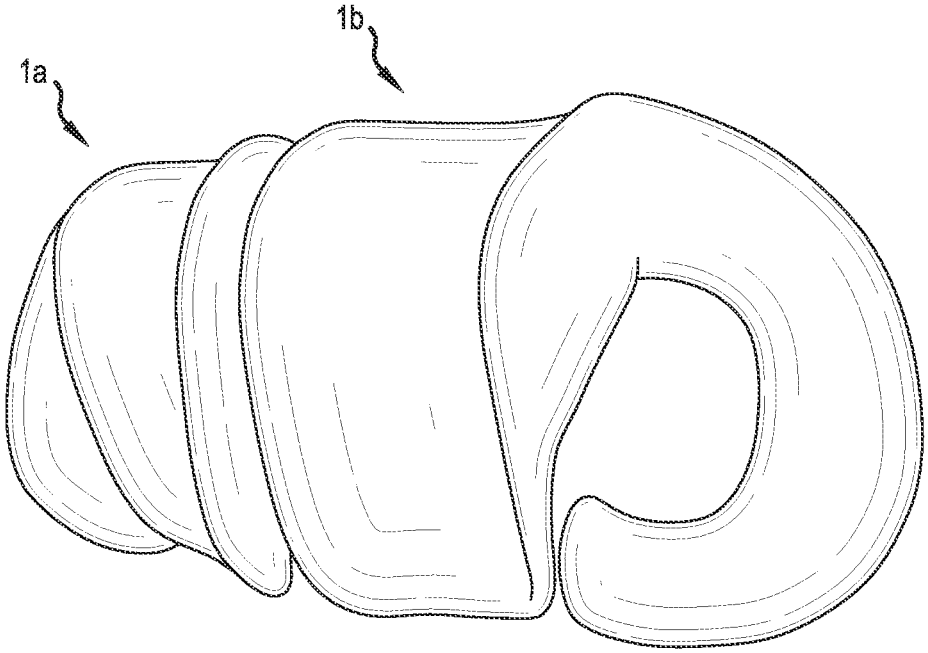
FIG. 1A shows a lower left side perspective view of left-handed and right-handed exemplary articles for athletic training, according to the present invention.
Figure 1B:
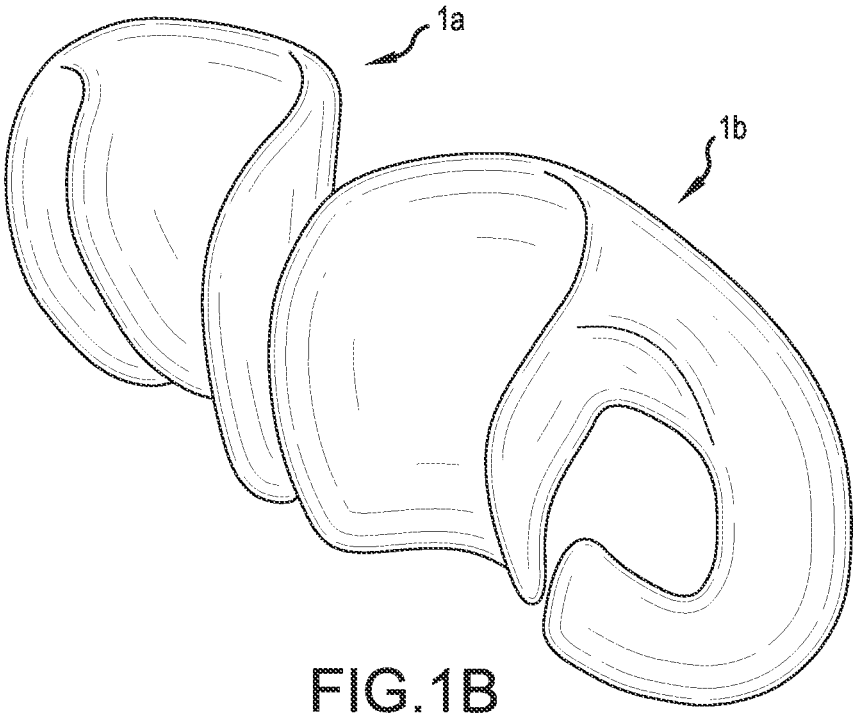
FIG. 1B shows an upper left side perspective view of left-handed and right-handed articles.
Figure 1C:
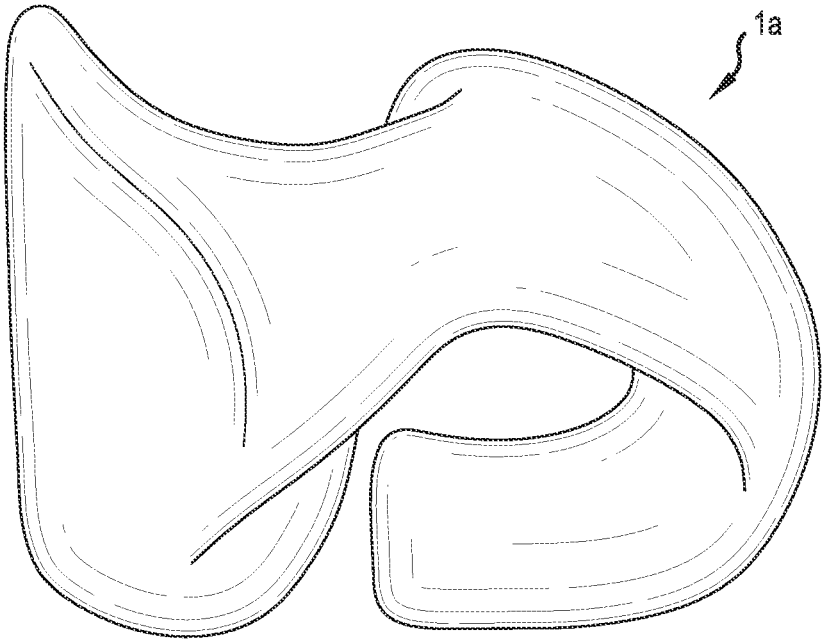
FIG. 1C shows an upper right perspective view of the left-handed article.
Figure 1D:
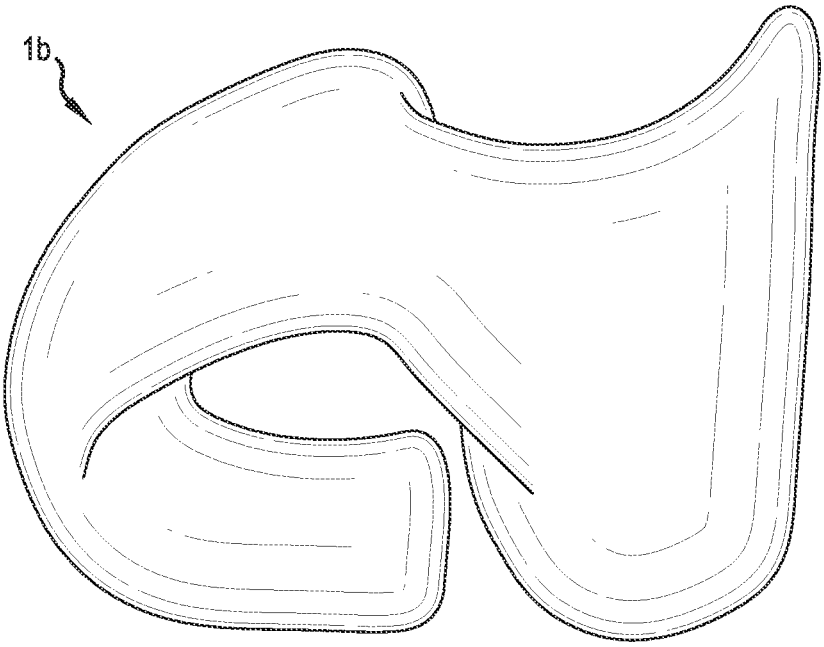
FIG. 1D shows an upper left perspective view of the right-handed article.
Figure 1E:
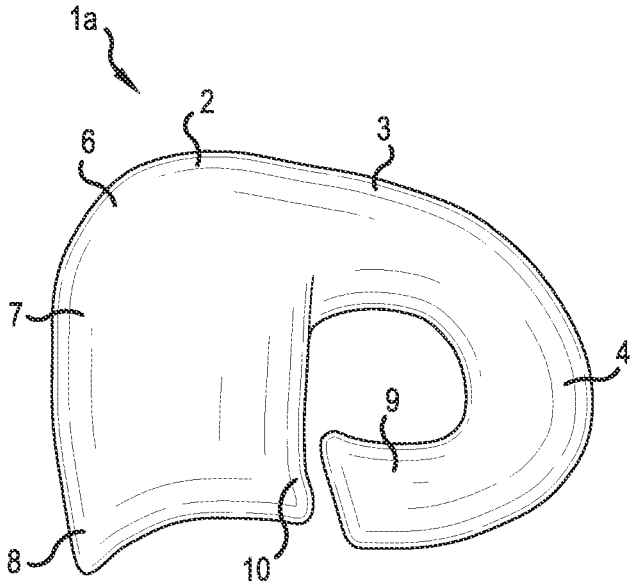
FIG. 1E shows a right-side view of the left-handed article.
Figure 1F:
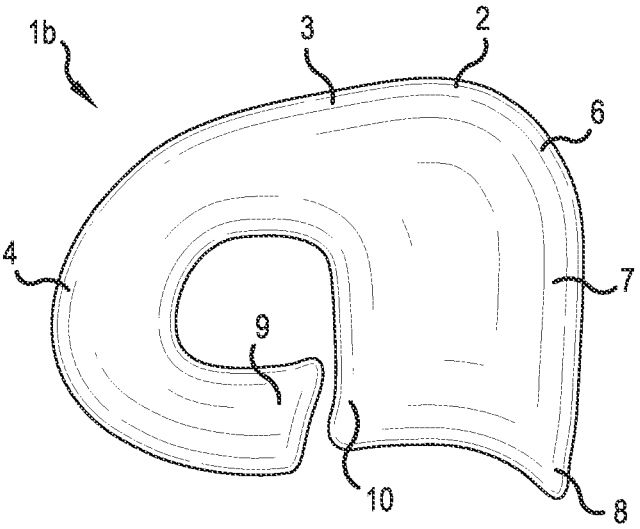
FIG. 1F shows a left-side view of the right-handed article.
Figure 1G:
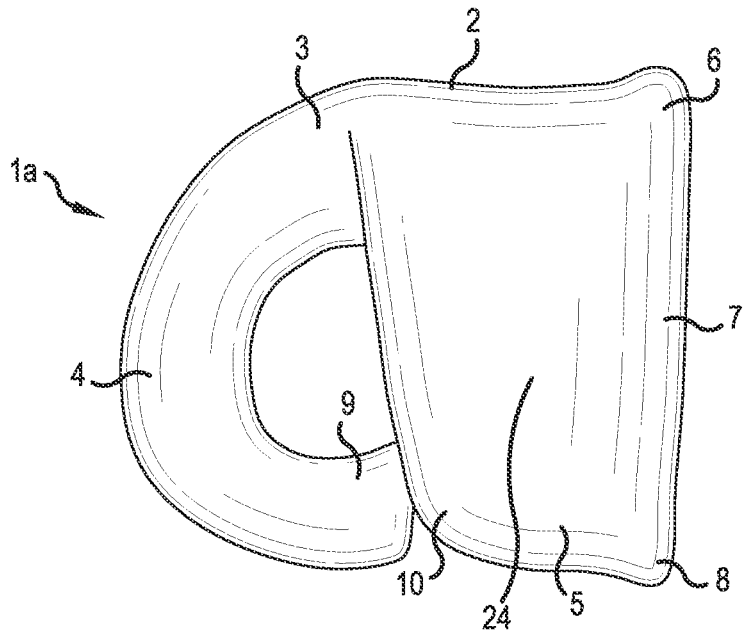
FIG. 1G shows a left-side view of the left-handed article.
Figure 1H:
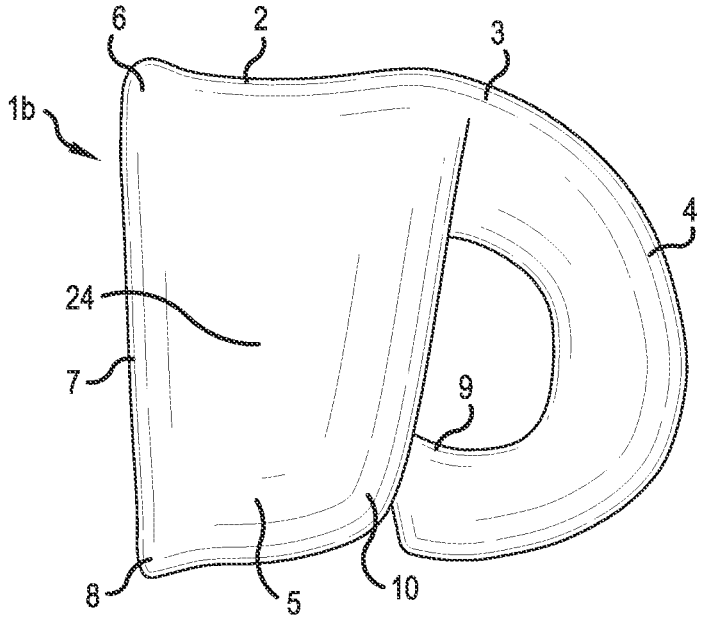
FIG. 1H shows a right-side view of the right-handed article.
Figure 1I:
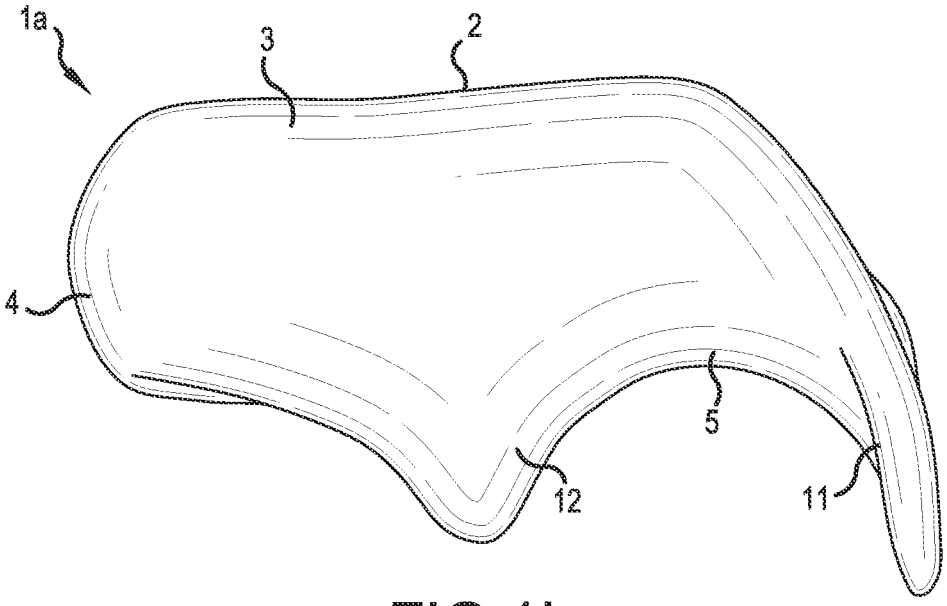
FIG. 1I shows a top-side view of the left-handed article.
Figure 1J:
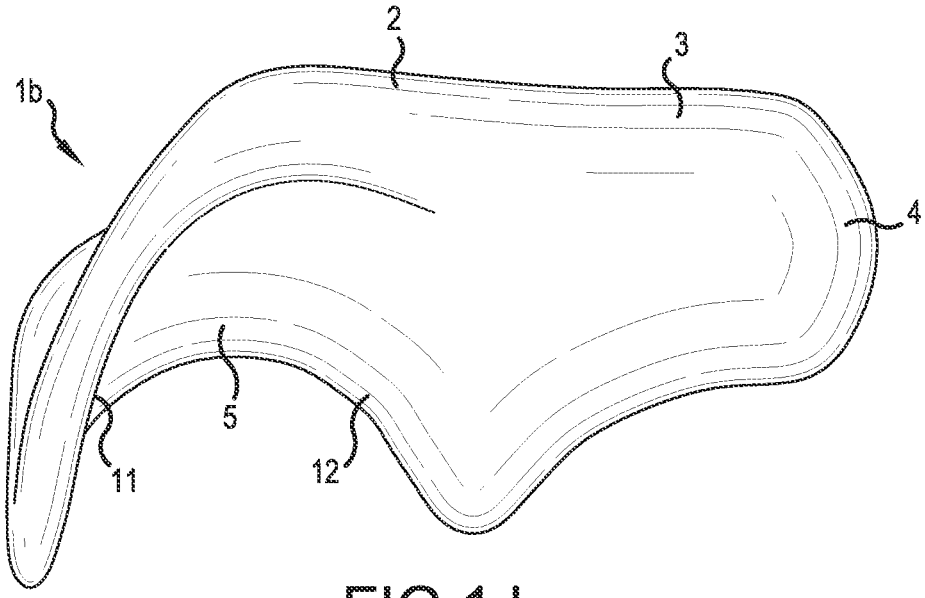
FIG. 1J shows a top-side view of the right-handed article.
Figure 1K:
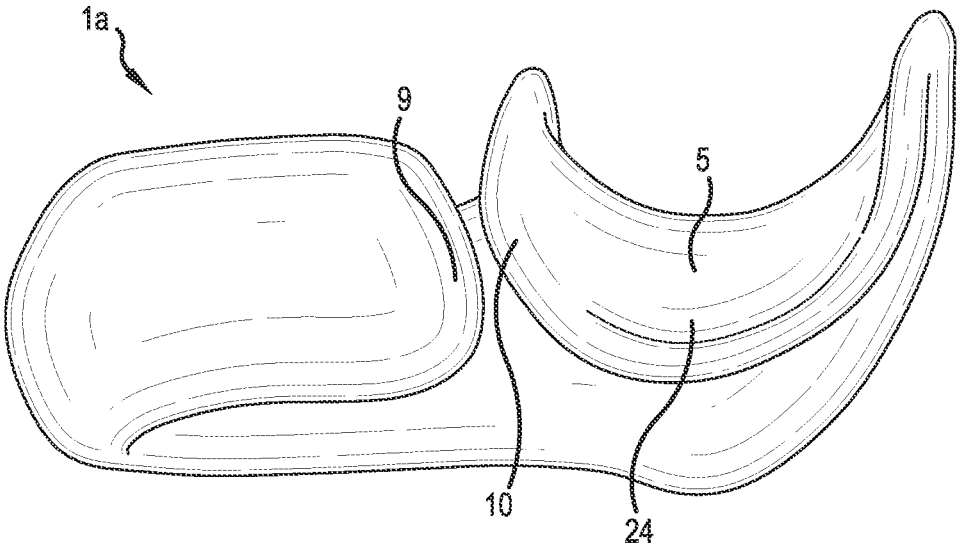
FIG. 1K shows a bottom-side view of the left-handed article.
Figure 1L:
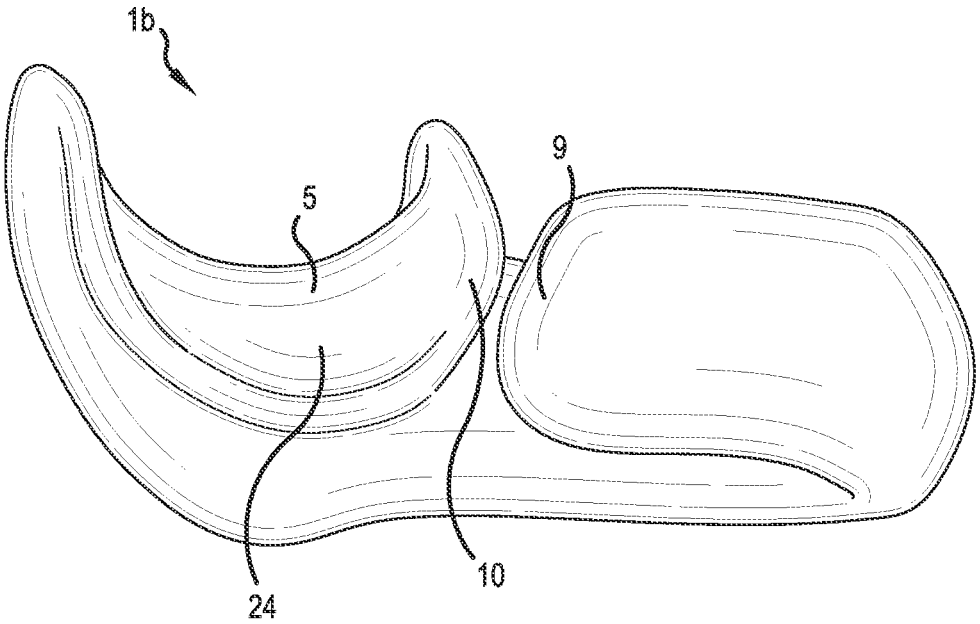
FIG. 1L shows a bottom-side view of the right-handed article.
Figure 2A:
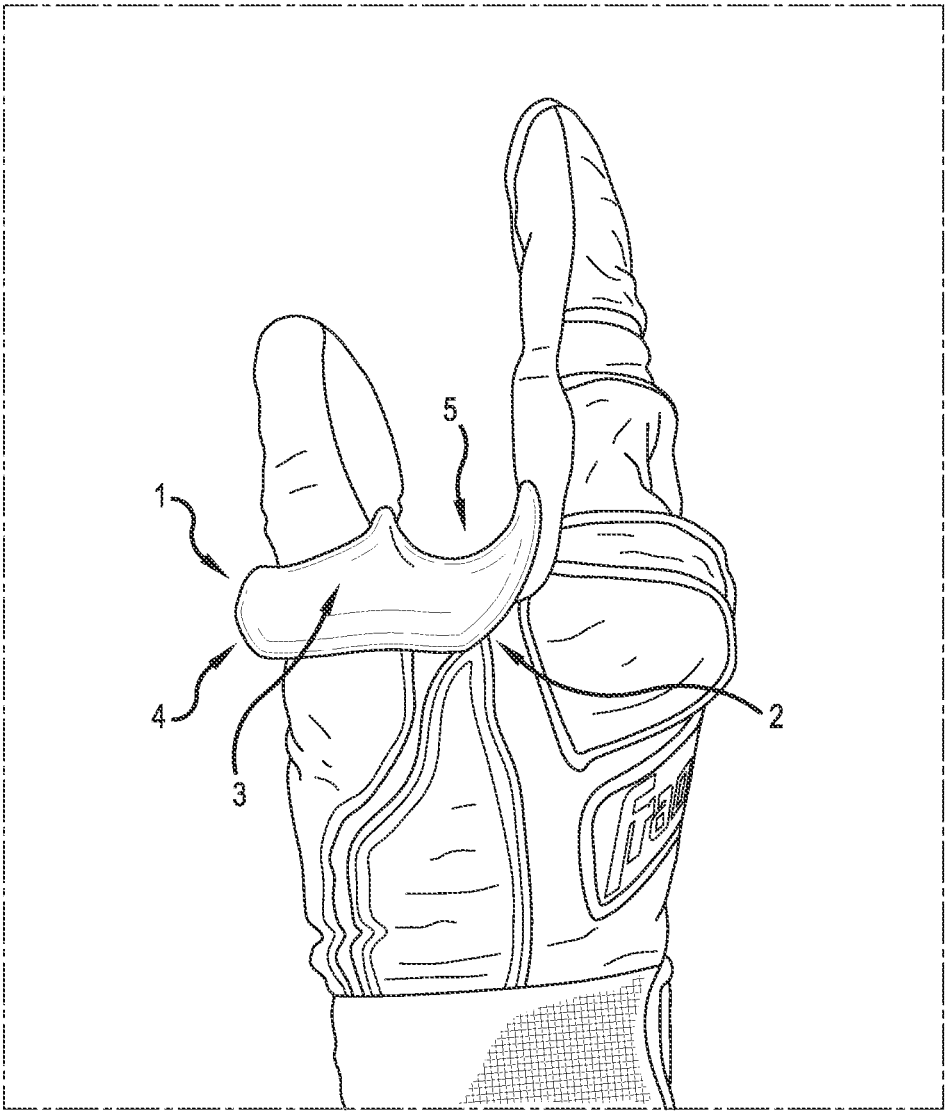
FIG. 2A shows an upper view of the right-handed article being worn by an upper hand of an individual.
Figure 2B:
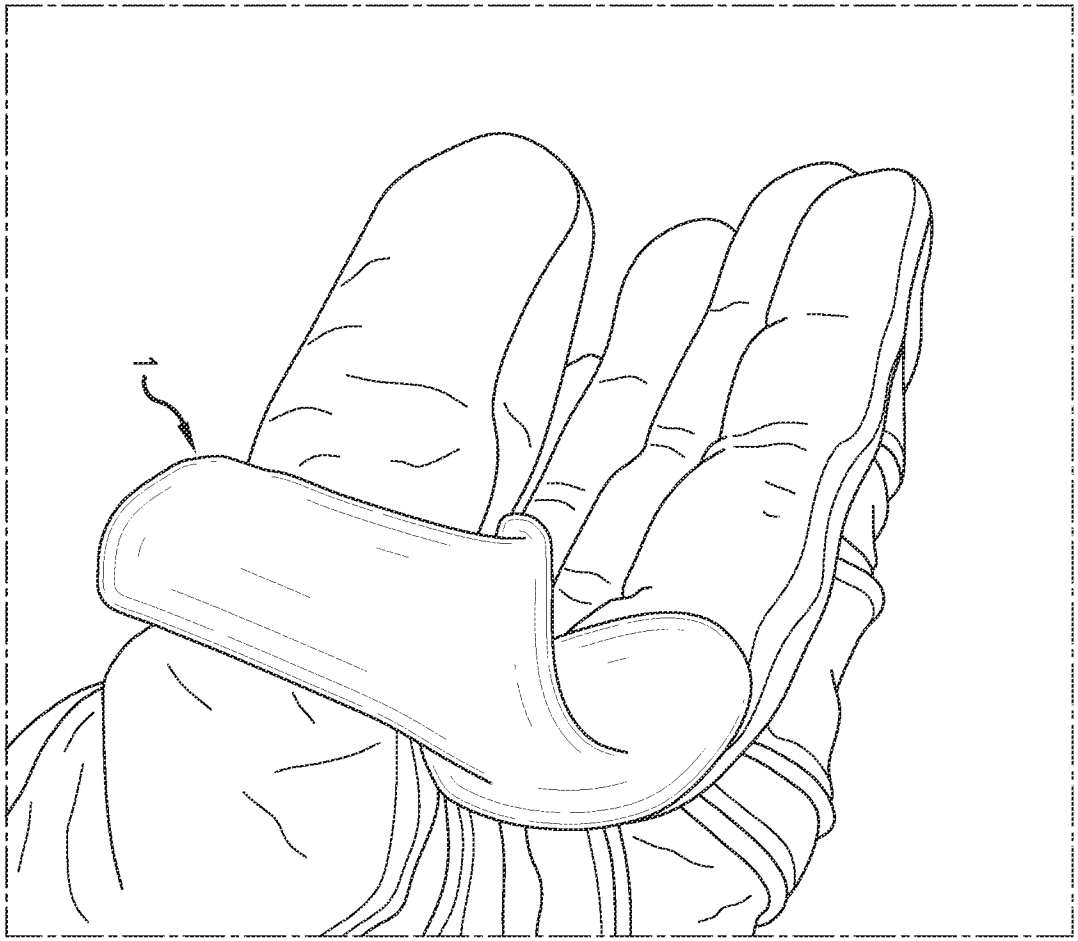
FIG. 2B shows a front side perspective view of the article being worn.
Figure 2C:
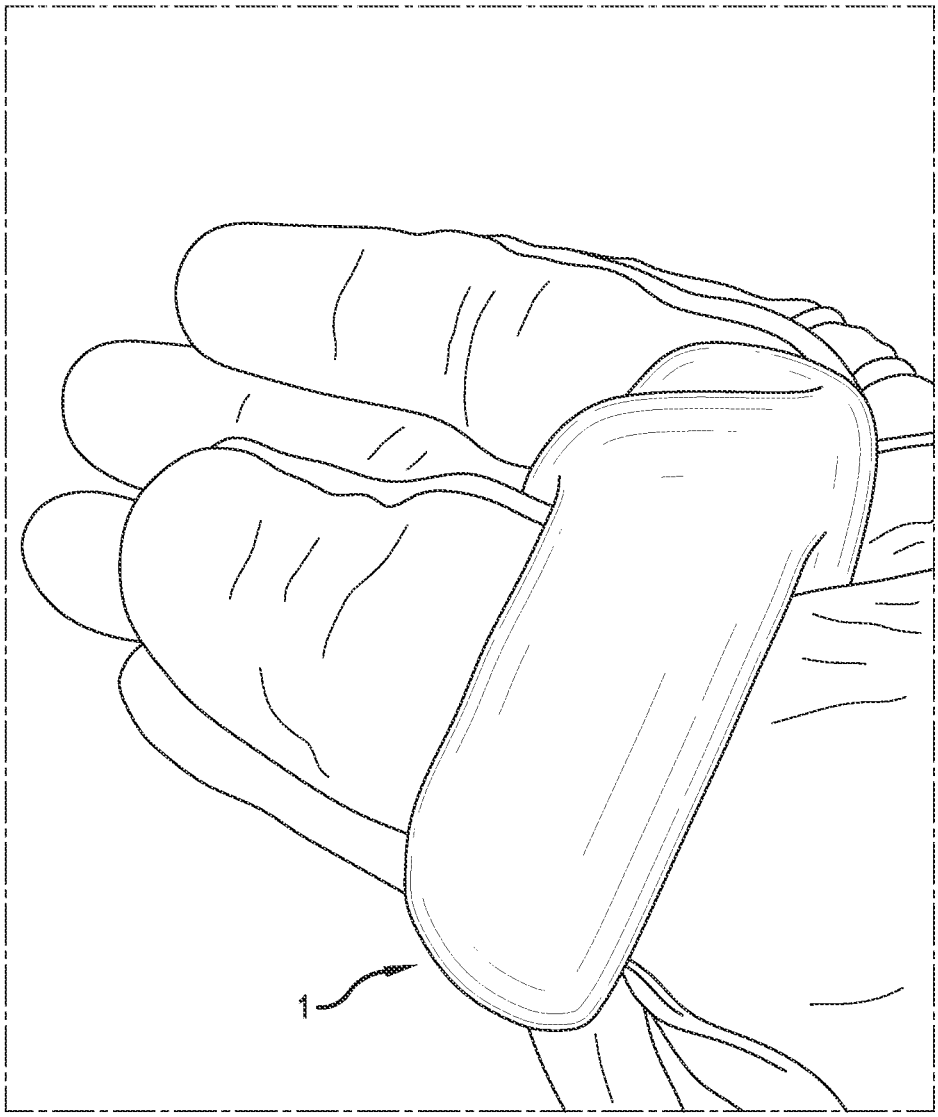
FIG. 2C shows a front lower side perspective view of the article being worn.
Figure 2D:
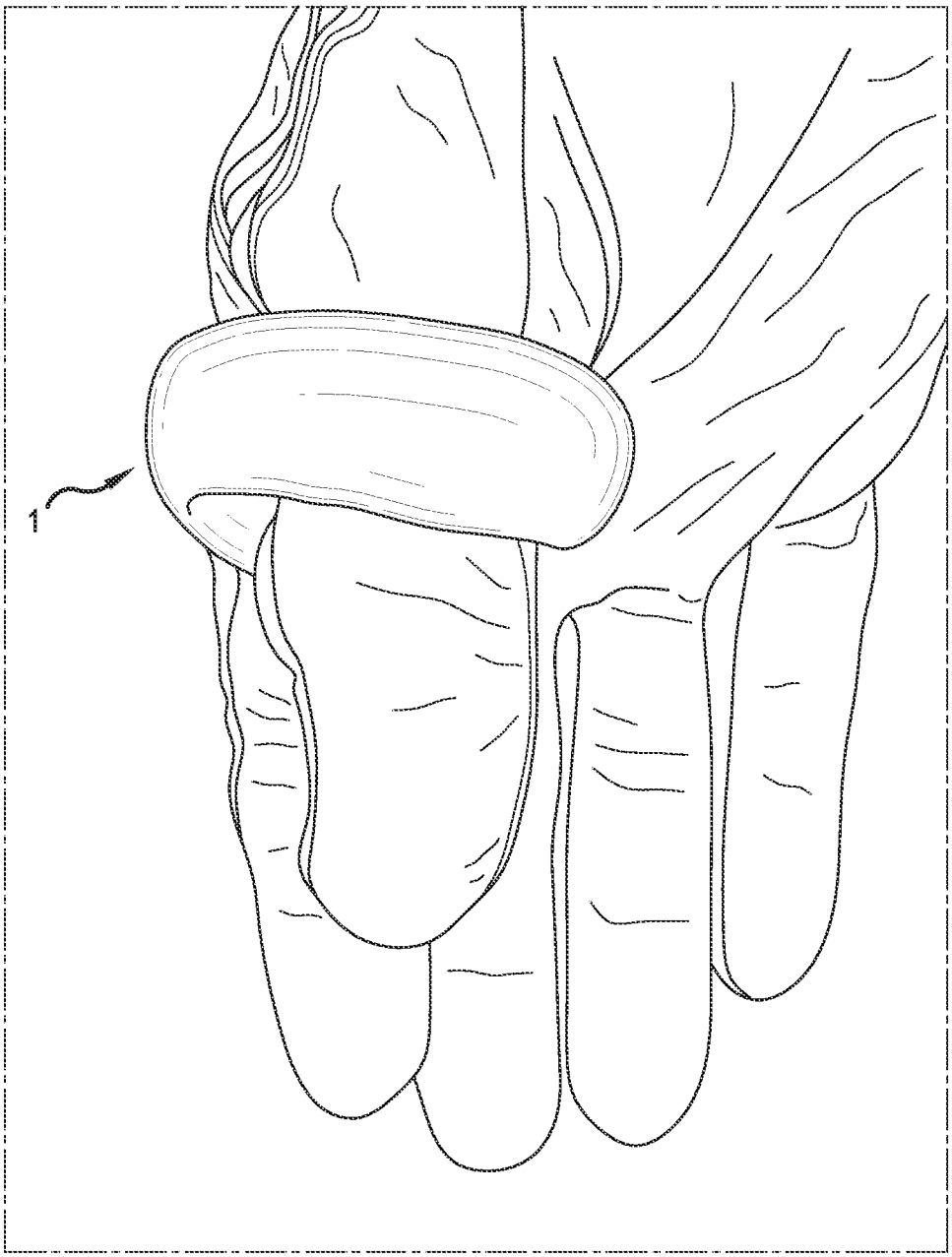
FIG. 2D shows a front view of the article being worn.
Figure 2E:
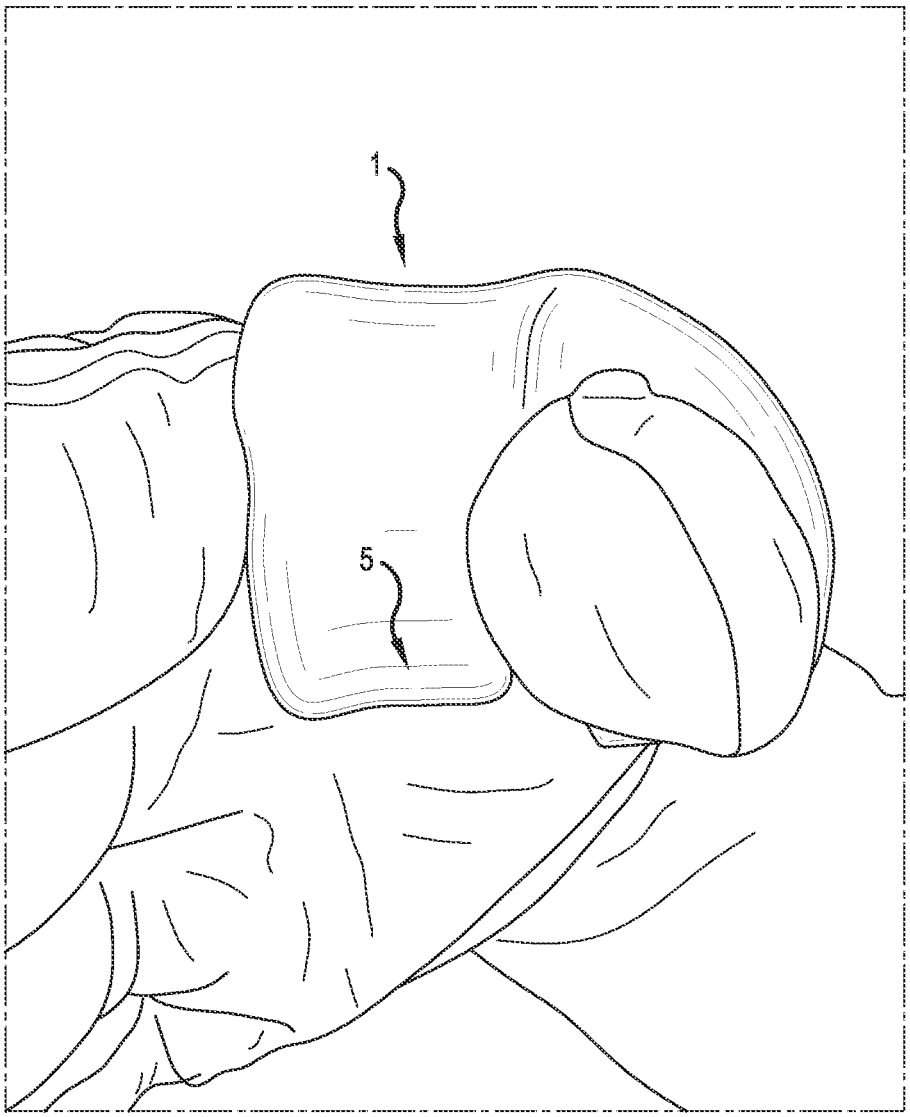
FIG. 2E shows a right-side view of the article being worn.
Figure 2F:
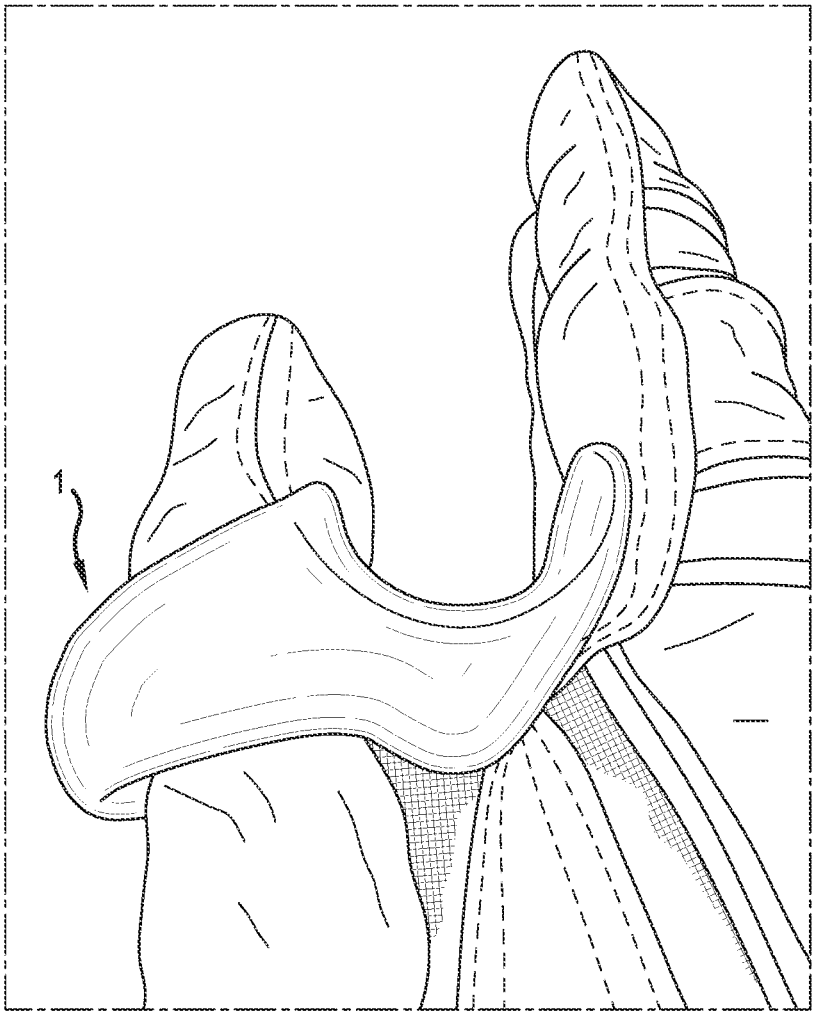
FIG. 2F shows a left side view of the article being worn.
Figure 3A:
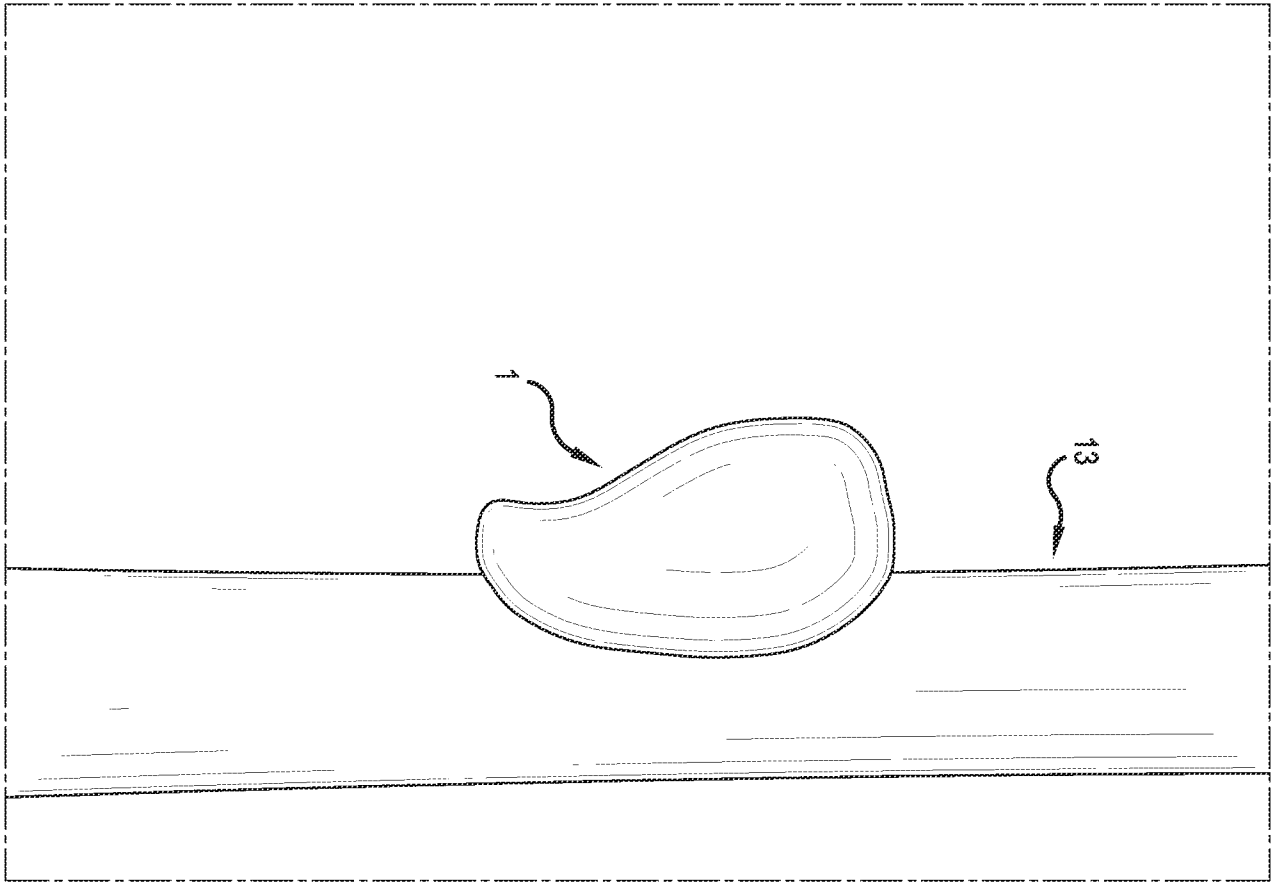
FIG. 3A shows a rear side view of the article adhered to a handled object.
Figure 3B:
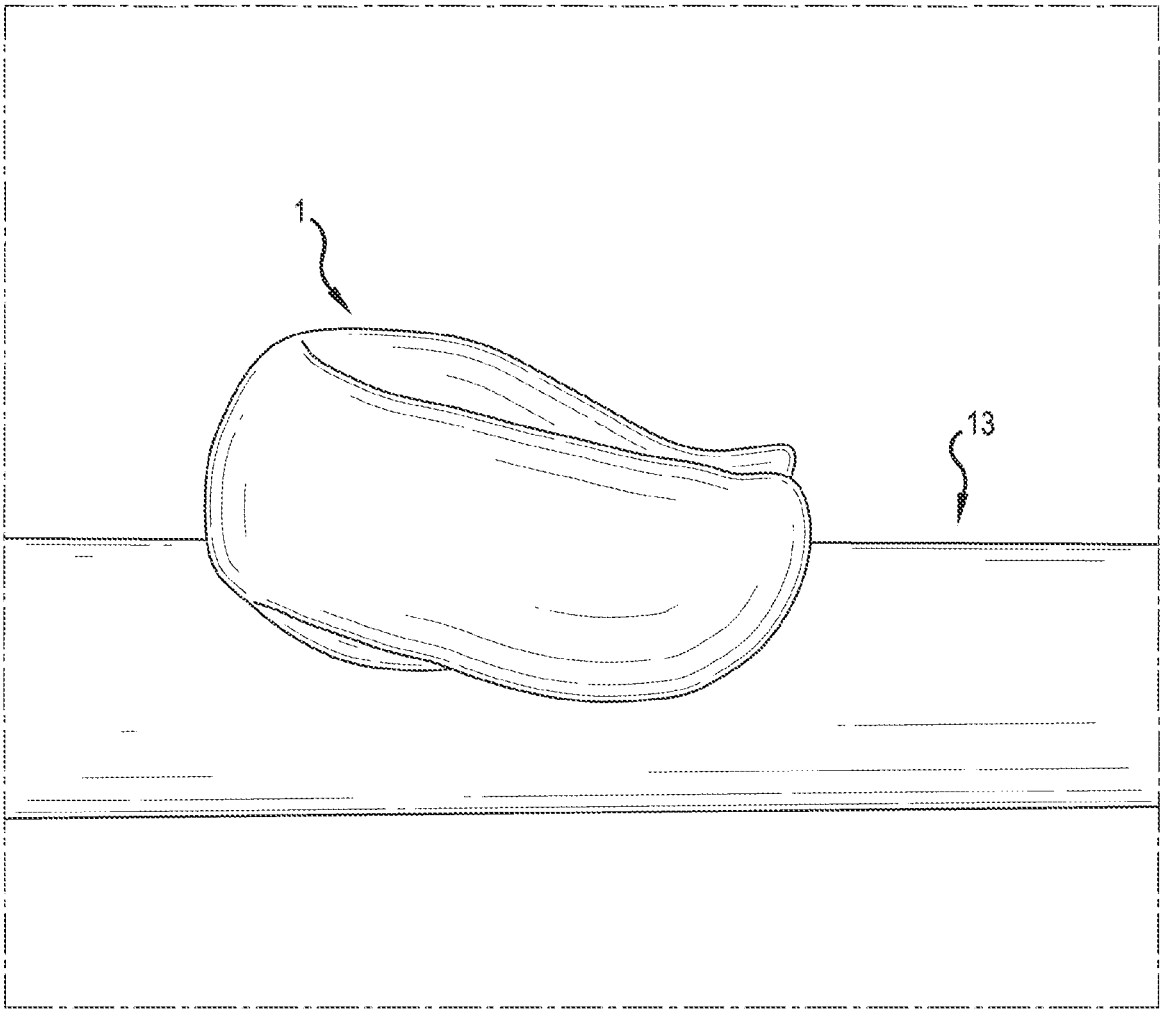
FIG. 3B shows a front side view of the article adhered to the handled object.
Figure 3C:
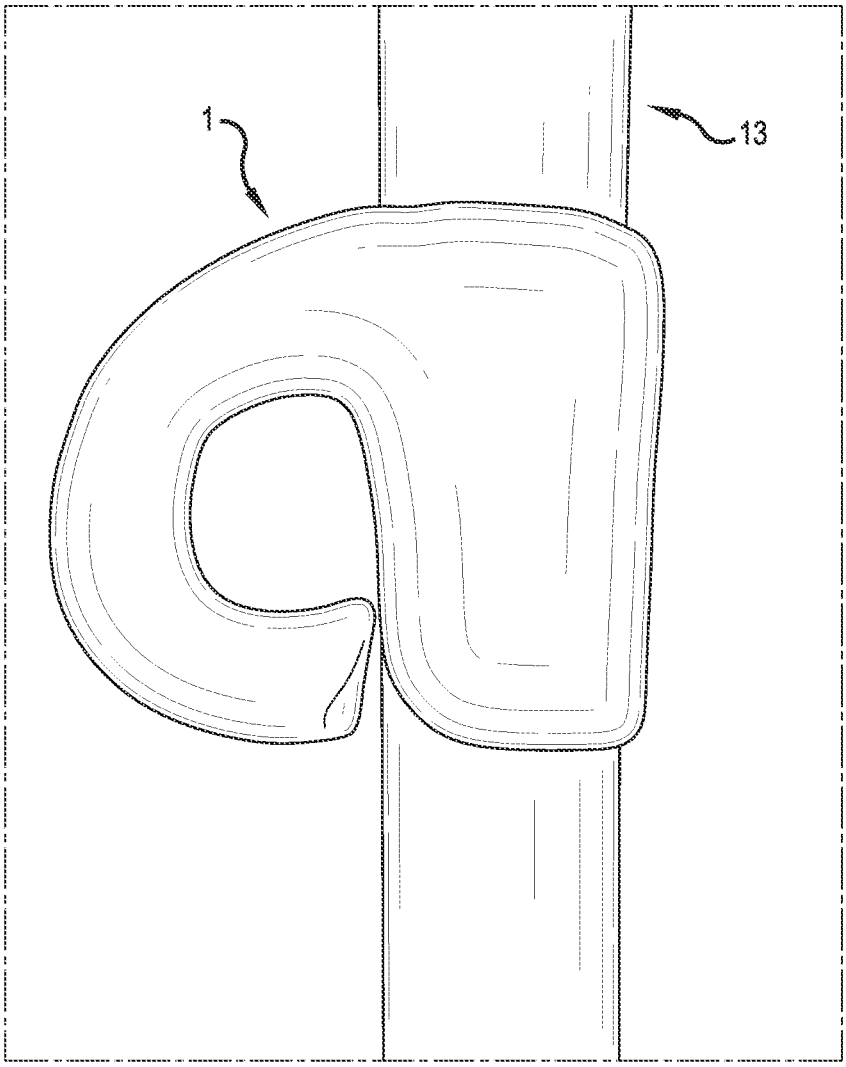
FIG. 3C shows a left side view of the article adhered to the handled object.
Figure 4A:
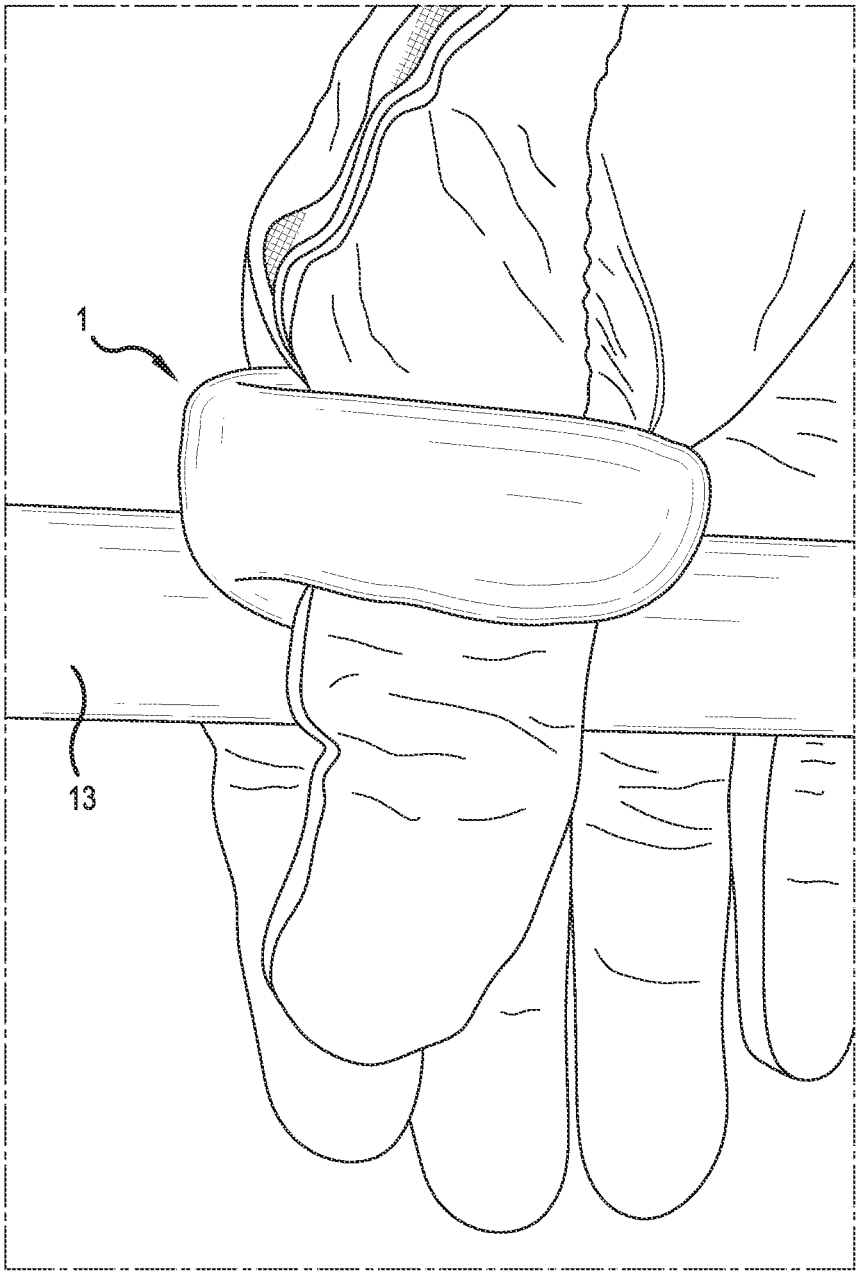
FIG. 4A shows a front side view of the article being worn and adhered to the handled object, with the wearer loosely grasping the hand.
Figure 4B:
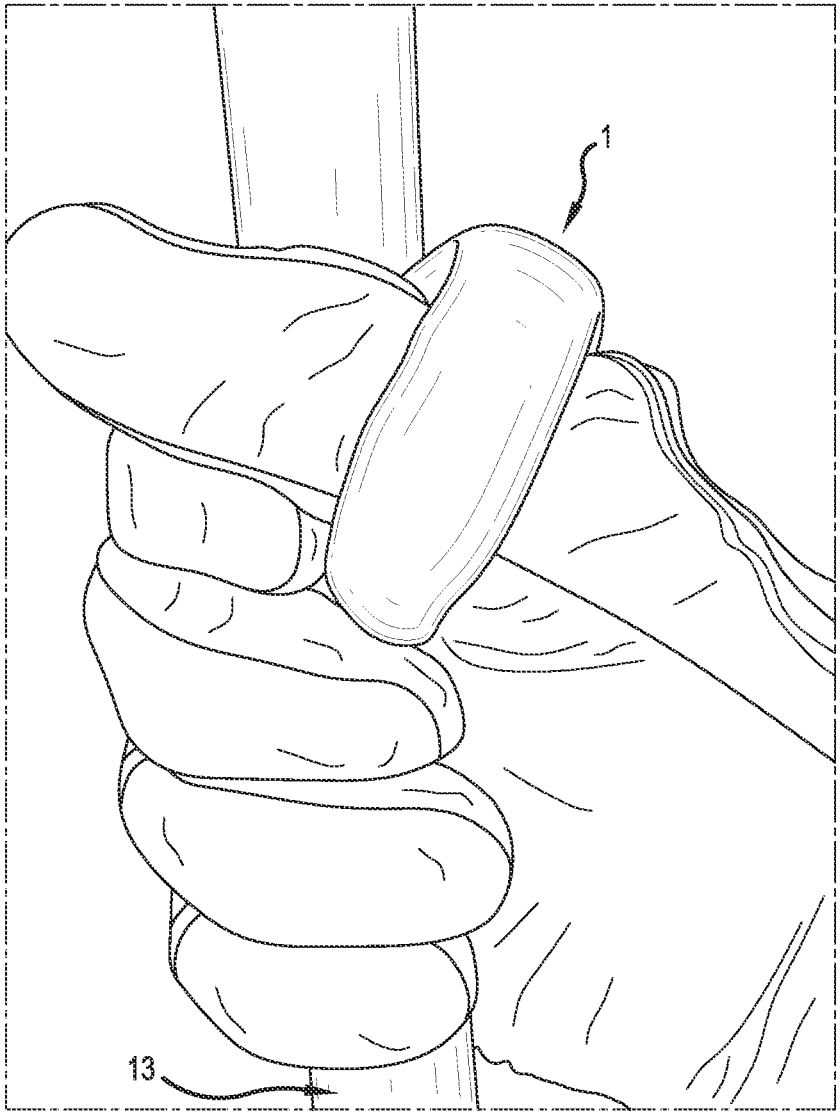
FIG. 4B shows a front side view of the article being worn and adhered to the handled object, with the wearer tightly grasping the hand.
Figure 4C:
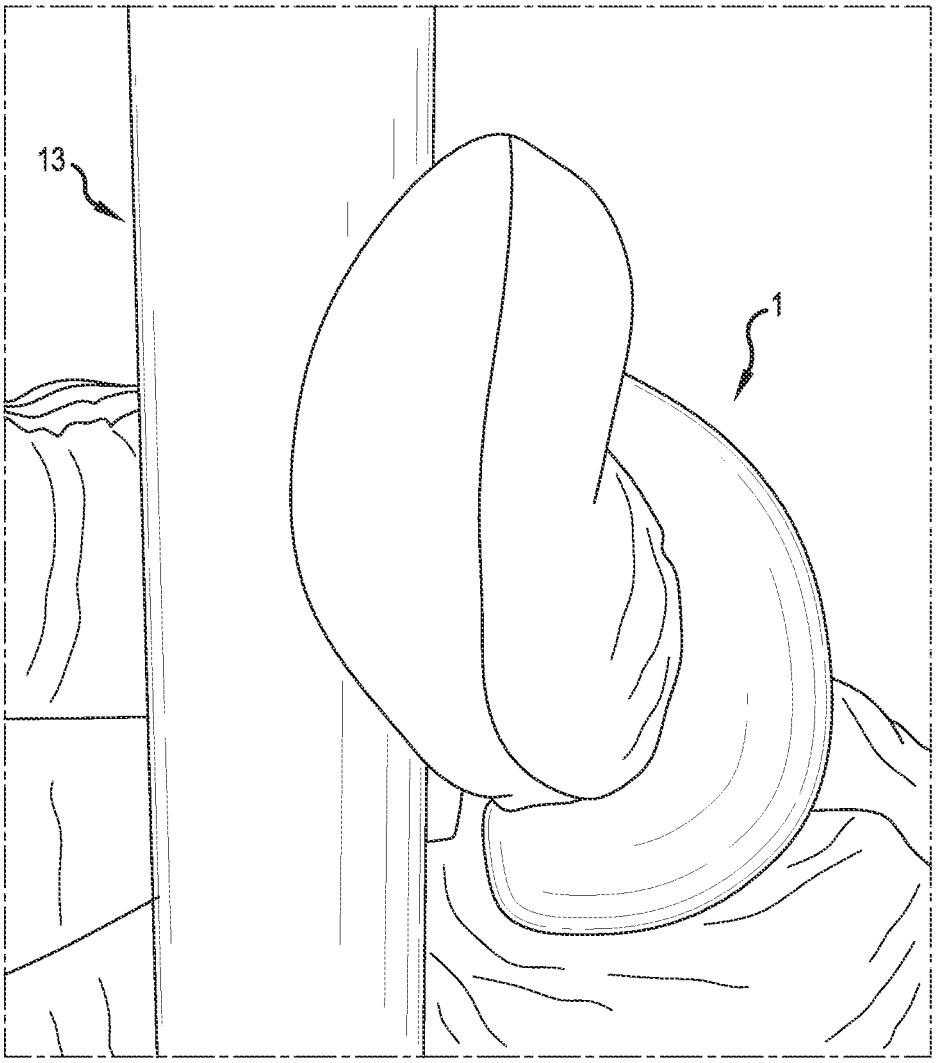
FIG. 4C shows a close-up perspective view of a thumb support of the article, through which the thumb of the hand is inserted to contact the handled object.

Reference is made herein to the attached drawings. Like reference numerals may be used in the drawings to indicate like or similar elements of the description. The figures are intended for representative purposes and should not be considered limiting.

The present disclosure can be understood more readily by reference to the following detailed description of the present disclosure and the examples included therein.

Before the present articles, systems, devices, and/or methods are disclosed and described, it is to be understood that they are not limited to specific implementations unless otherwise specified, or to particular approaches unless otherwise specified, as such can, of course, vary. It is also to be understood that the terminology used herein is for the purpose of describing aspects only and is not intended to be limiting. Although any methods and materials similar or equivalent to those described herein can be used in the practice or testing of the present disclosure, example methods and materials are now described.

All publications mentioned herein are incorporated herein by reference to disclose and describe the methods and/or materials in connection with which the publications are cited.

DEFINITIONS

It is to be understood that the terminology used herein is for the purpose of describing particular aspects only and is not intended to be limiting. As used in the specification and in the claims, the term "comprising" can include the aspects "consisting of" and "consisting essentially of" Unless defined otherwise, all technical and scientific terms used herein have the same meaning as commonly understood by one of ordinary skill in the art to which this present disclosure belongs. In this specification and in the claims which follow, reference will be made to a number of terms which shall be defined herein.

As used in the specification and the appended claims, the singular forms "a," "an," and "the" include plural referents unless the context clearly dictates otherwise. Thus, for example, reference to "an opening" can include two or more openings.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two units are also disclosed. For example, if 10 and 15 are disclosed, then 11, 12, 13, and 14 are also disclosed.

As used herein, the terms "about" and "at or about" mean that the amount or value in question can be the value designated or some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including matters of logic with respect to arrangement of steps or operational flow; plain meaning derived from grammatical organization or punctuation; and the number or type of aspects described in the specification.

Disclosed are the components to be used to manufacture the disclosed devices, systems, and articles of the present disclosure as well as the devices themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the present disclosure. Thus, if there are a variety of additional steps that can be performed it is understood that each of these additional steps can be performed with any specific aspect or combination of aspects of the methods of the present disclosure.

Athletic Grasp Training Articles

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

Referring now to FIGS. 1A-1L, 2A-2F, 3A-3C, and 4A-4C, there are shown several views of exemplary right-handed and/or left-handed articles for training top-hand athletic grasp of a handled object, according to the present invention. Generally, the invention relates to improved articles 1 for training an individual's top-hand grasp of a handled object 13, comprising an arcuate inner portion 2 configured to engage the handled object 13 and an irregular outer portion 3 comprising a thumb support 4. The irregular outer portion 3 is configured to engage the palm and thumb of the individual's top-hand, such that the handled object 13 is grasped with the fingers of the individual's top-hand. The article may be chiral and configured for use with either a left hand or a right hand, as shown. The article may be comprised of a single continuous and unitary structure and may not be comprised of a plurality of structures, which may increase durability and enable the article to withstand significant forces during use.

The article may include a width that tapers from a medial portion 7 of the article 1 to a lower portion 8 of the article 1 to improve the individual's top-hand grasp. This may also allow the bottom-hand to abut against a lower portion of the top-hand during use. In this manner, the individual may grasp the handled object 13 according to a suitable technique. In the shown embodiment, an upper portion 6 of the article is about the same width as the medial portion 7, such that the individual is able to contact the handled object 13 with the fingers. As would be understood by the person having ordinary skill in the art, changes to width and tapering of the article 1 may be made to accommodate different-sized top-hands to maintain proper technique; for example, a wider width may accommodate a larger hand and a narrower width may accommodate a smaller hand. Variations to size and shape may be made without departing from the scope of the present invention.

The arcuate inner portion 2 may comprise a groove 5 that extends along a longitudinal axis thereof, such that the groove 5 is configured to secure the article to the handled object 13 during use. The groove 5 may extend along a full length of the arcuate inner portion 2 to maximize this securement, as shown, however, in alternate embodiments, may extend along a length that is less than the full length of the arcuate inner portion 2. The groove 5 may be formed by walls 11, 12 which form a "U" shape or a "V" shape, a fulcrum 24, and the groove 5. The fulcrum may be in the form of a peak that is oriented across the body of the article (1*a*, 1*b*), as shown. The groove 5 and the walls 11, 12 and the fulcrum 24 work together to secure the article to the handled object while simultaneously allowing for a dynamic rocking motion within the groove 5 when the article is pressed against a handled object 13, thereby not biomechanically constraining the individual's hand and wrist which may place unwanted and unnatural torque on individual's hand and wrist. The groove 5 and the walls 11, 12 and the fulcrum 24 also enable the individual to easily and naturally release the handle from the individual's hand and the article whenever they loosen their grip. In this manner, the article 1 may not lose contact with the handled object 13 and the individual is better able to grasp the article 1 and the handled object 13 during use.

The thumb support 4 may arcuately extend outward from the irregular outer portion 3 and away from the arcuate inner portion 2 to allow an ergonomic grasp of the article 1 and the handled object 13 by the individual. In addition, the thumb support 4 may form a semi-circular loop 9 into which the thumb of the individual's top-hand may be inserted. In this manner, the individual may effectively grasp the article with the thumb and palm of the top-hand, and the handled object 13 with the fingers of the top-hand to improve athletic technique.

The loop 9 is shown as a semi-circle and a terminal end of the loop 9 does not contact a portion 10 of the outer portion 3, however, in alternate embodiments, the terminal end of the loop 9 may contact the portion 10 of the outer portion 3 and form a circle or closed loop through which the thumb may be inserted. Variations in size and shape, including variations in design and placement of the thumb support 5, may be made without departing from the scope of the present invention.

Athletic Grasp Training Kits

The present invention also provides kits which comprise, at least, an athletic grasp training article of the present invention, optionally combined with other materials such as instructional materials, a handled object (e.g., a bat, a club, etc.), a ball, etc. In this manner, the present invention involves not only articles but also kits which may be provided as a unit to an individual such as a consumer, e.g., an athlete or an aspiring athlete.

Athletic Grasp Training Methods

Figure 5A:
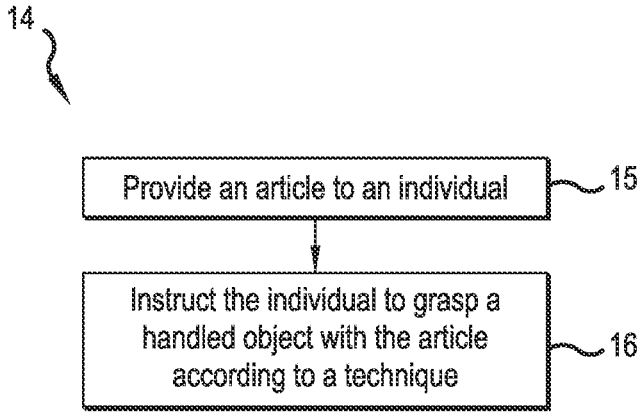
FIG. 5A shows a method of assisting an individual with an athletic technique using an article of the present invention.

Referring now to FIG. 5A, there is shown a method of assisting an individual with an athletic technique using an article of the present invention. A method of assisting an individual with an athletic technique comprises providing 15 an article to an individual, and instructing 16 the individual to grasp a handled object with the article according to a technique, such as an athletic technique. The instructing 16 may involve verbal explanations or physical demonstrations, e.g., coaching activities.

Figure 5B:
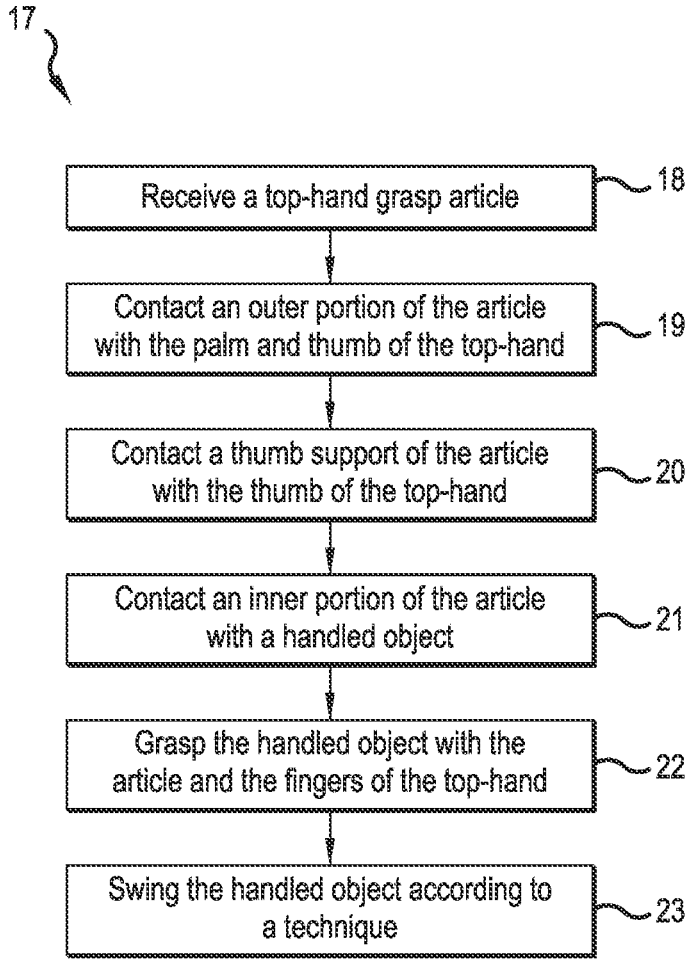
FIG. 5B shows a method of implementing an athletic technique using an article of the present invention.

Referring now to FIG. 5B, there is shown a method of implementing an athletic technique using an article of the present invention. A method 17 of implementing or training an athletic technique using an article comprises receiving 18 an article (e.g., a top-hand grasp article as disclosed herein); contacting 19 an outer portion (e.g., irregular outer portion) of the article with the palm and thumb of the top-hand of the individual; contacting 20 a thumb support of the article with the thumb of the top-hand, contacting 21 an inner portion (e.g., an arcuate inner portion that includes a groove thereon) of the article with a handled object (e.g., a bat, a club, etc.) (e.g., to form a vacuum or a partial vacuum), grasping 22 the handled object with the article and the fingers of the top-hand; and swinging 23 the handled object according to a technique. The method may also include reviewing or learning from the technique and adjusting the individual's top-hand grasp to try to improve the technique in subsequent iterations of the method.

The method may be performed using any suitable article of the invention, including but not necessarily limited to chiral articles configured for either a left hand or a right hand, continuous and unitary articles, articles having a width that tapers from a medial portion of the article to a lower portion of the article, articles wherein the arcuate inner portion comprises a groove that extends along a longitudinal axis thereof and wherein the groove is configured to secure the article to the handled object, articles wherein the groove extends along a full length of the arcuate inner portion, articles wherein the thumb support arcuately extends outward from the irregular outer portion and away from the arcuate inner portion, articles wherein the thumb support forms a semi-circular loop into which the thumb of the individual's top-hand may be inserted, and the like. In this manner, methods are provided which are suitable for use with the articles and kits of the invention, and which may correspond thereto.

The methods may be used for improving top-hand grasp of any handled object but may be especially suitable for improving top-hand grasp for an athletic technique such as swinging a bat or club. In addition, the articles, kits, and methods may be used for existing sports, including but not necessarily limited to baseball, tee-ball, softball, cricket, golf, and any combination thereof, and may also be used for non-existing sports, such as sports that have yet to be invented. Thus, the articles, kits, and methods provide general approaches for improving the top-hand grasp for any corresponding two-handed grasp for any sport or activity.

While aspects of the present disclosure can be described and claimed in a particular statutory class, such as the system statutory class, this is for convenience only and one of skill in the art will understand that each aspect of the present disclosure can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way appreciably intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications can be referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present disclosure is not entitled to antedate such publication by virtue of prior present disclosure. Further, the dates of publication provided herein can be different from the actual publication dates, which can require independent confirmation.

The patentable scope of the present disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Insofar as the description above and the accompanying drawing disclose any additional subject matter that is not within the scope of the claims below, the disclosures are not dedicated to the public and the right to file one or more applications to claims such additional disclosures is reserved.

The foregoing descriptions of specific embodiments of the present invention have been presented for purposes of illustration and description. They are not intended to be exhaustive or to limit the present invention to the precise forms disclosed, and modifications and variations are possible in view of the above teaching. The exemplary embodiment was chosen and described to best explain the principles of the present invention and its practical application, to thereby enable others skilled in the art to best utilize the present invention and its embodiments with modifications as suited to the use contemplated.

It is therefore submitted that the present invention has been shown and described in the most practical and exemplary embodiments. It should be recognized that departures may be made which fall within the scope of the invention. With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the present invention.

The following is claimed:

1. An article for training an individual's top-hand grasp of a handled object, comprising:

an arcuate inner portion configured to engage the handled object, and an irregular outer portion comprising a thumb support, wherein the thumb support arcuately extends outward from the irregular outer portion and away from the arcuate inner portion encircling the thumb, wherein the irregular outer portion is configured to engage palm and thumb of the individual's top-hand, such that the handled object is grasped with fingers of the individual's top-hand.

2. The article of claim 1, wherein the article is chiral and is configured for either a left hand or a right hand.

3. The article of claim 1, wherein the article is continuous and unitary.

4. The article of claim 1, wherein a width of the article tapers from a medial portion of the article to a lower portion of the article.

5. The article of claim 1, wherein the arcuate inner portion comprises a groove that extends along a longitudinal axis thereof, wherein the groove is configured to secure the article to the handled object.

6. The article of claim 5, wherein the thumb support forms a semi-circular loop into which the thumb of the individual's top-hand may be inserted.

7. The article of claim 5, wherein the groove extends along a full length of the arcuate inner portion.

8. An article for training an individual's top-hand grasp of a handled object, comprising:

an arcuate inner portion configured to engage the handled object that comprises a groove that extends along a full length of the arcuate inner portion, wherein the groove is configured to secure the article to the handled object, and an irregular outer portion comprising a thumb support that arcuately extends outward from the irregular outer portion and away from the arcuate inner portion and forms a semi-circular loop into which the thumb of the individual's top-hand may be inserted, wherein the irregular outer portion is configured to engage the palm and thumb of the individual's top-hand, such that the handled object is grasped with fingers of the individual's top-hand encircling the thumb; and wherein a width of the article tapers from a medial portion of the article to a lower portion of the article.

9. The article of claim 8, wherein the article is continuous and unitary and chiral such that it is configured for either a left hand or a right hand.

10. A method for training an individual's top-hand grasp of a handled object, comprising: contacting an irregular outer portion of an article with the palm and thumb of the individual's top-hand, contacting the thumb of the individual's top-hand with a thumb support of the irregular outer portion, wherein the thumb support forms a semi-circular loop into which the thumb of the individual's hand is inserted encircling the thumb;

contacting an arcuate inner portion of the article with the handled object, grasping the handled object with the article and fingers of the individual's top-hand, and swinging the handled object according to a technique.

11. The method of claim 10, wherein the article is chiral and is configured for either a left hand or a right hand.

12. The method of claim 10, wherein the article is continuous and unitary.

13. The method of claim 10, wherein a width of the article tapers from a medial portion of the article to a lower portion of the article.

14. The method of claim 10, wherein the arcuate inner portion comprises a groove that extends along a longitudinal axis thereof, wherein the groove is configured to secure the article to the handled object.

15. The method of claim 14, wherein the groove extends along a full length of the arcuate inner portion.

16. The method of claim 10, wherein the thumb support arcuately extends outward from the irregular outer portion and away from the arcuate inner portion.

17. The method of claim 10, wherein the technique is an athletic technique for use with a sport.

18. The method of claim 17, wherein the sport is selected from a group consisting of: baseball, tee-ball, softball, cricket, golf, and any combination thereof.

* * * * *